US005829092A

United States Patent [19]

Hobbs

[11] Patent Number: 5,829,092

[45] Date of Patent: Nov. 3, 1998

[54] VACUUM CLEANER

[76] Inventor: Roy Hobbs, 1102 Lower Bridge Rd., Crawfordville, Fla. 32327

[21] Appl. No.: 710,836

[22] Filed: Sep. 23, 1996

[51] Int. Cl.[6] ..... A47L 9/18

[52] U.S. Cl. ..... 15/352; 15/327.1; 15/353; 55/256

[58] Field of Search ..... 15/327.1, 352, 15/353, 327.6; 55/256

[56] References Cited

U.S. PATENT DOCUMENTS

| | | | |
|---|---|---|---|
| 963,139 | 7/1910 | Griffiths | 15/327.1 X |
| 2,242,278 | 5/1941 | Yonkers | 15/327.6 X |
| 2,909,800 | 10/1959 | Grindle et al. | 15/353 X |
| 2,962,118 | 11/1960 | Lee et al. | 15/327.1 X |
| 3,663,985 | 5/1972 | Burgoon | 15/353 |
| 3,731,465 | 5/1973 | Ohira et al. | 15/327.6 X |
| 3,871,847 | 3/1975 | Fish | 15/327.6 X |
| 4,393,538 | 7/1983 | Olson | 15/353 X |
| 4,547,206 | 10/1985 | Sovis et al. | 15/353 X |

*Primary Examiner*—Chris K. Moore
*Attorney, Agent, or Firm*—Peter Loffler

[57] ABSTRACT

A vacuum cleaner is comprised of a housing having a removable filter chamber and a motor chamber fluid flow connected by a connection chamber. Fluid is held within a basin located at the bottom of the filter chamber. An air intake hose has one end open for vacuum accessory attachment and the opposing end received within the fluid. A fan, located within the motor chamber, draws air from and creates a vacuum within the filter chamber for drawing an air stream through the air intake hose. A filter provides a moisture barrier between the filter chamber and the connection chamber.

43 Claims, 4 Drawing Sheets

VACUUM CLEANER

BACKGROUND OF THE INVENTION

1. Field of the Invention

The present invention relates generally to vacuum cleaners and more particularly concerns dust filtration by the use of an improved fluid filter system.

2. Background of the Prior Art

Most vacuum cleaners use a dry porous filter to remove debris from the air stream. Such filters allow much of the fine dust to pass through the filter with the exhaust air. As a dry filter fills up, it stops up causing air flow reduction therethrough and thus the vacuum cleaner's ability to clean.

Vacuum cleaners employing a fluid filter have been proposed in order to provide better filtration. However, due to design limitations of current fluid filters, they suffer from unreliable filtration and water contamination of the motor bearing elements greatly reducing device reliability and longevity. Furthermore, these device are difficult to clean after use.

Therefore, a need exists in the art for a vacuum cleaner having fluid filtration that overcomes the above-stated problems. Such a device must be simple in design, economical to manufacture, and provide improved filtration. The device must provide improved fluid separation from working air and should be easy to clean after use.

SUMMARY OF THE INVENTION

The vacuum cleaner of the present invention addresses the aforementioned needs in the art. The present invention provides a vacuum cleaner that utilizes fluid, namely water, as a filtration system. The entire incoming air stream comes in contact with the fluid so that debris from the entire stream is removed by and retained within the fluid regardless of particle size. Fluid is prohibited from contacting the vacuum motor or from exiting the device.

The vacuum cleaner of the present invention is comprised of a caster-based housing separated into a filter chamber and a motor chamber air flow connected by a connection chamber. The filter chamber, which is removably disposed within the housing, is divided into several sections. A fluid basin, having fluid therein, is located at the base of the filter chamber. A lower air section is located above the fluid basin and is separated from a upper air section—volumetrically larger than the lower air section—by a separator. A filter provides a moisture barrier between the filter chamber and the connection chamber. An air intake hose extends diagonally upwardly from within the fluid and terminates prior to an opening located on the housing, exterior of the fluid. Vacuum accessories are attachable to the latter end of the air intake hose. A fan, powered by a bypass motor, is disposed within the motor chamber. An air duct, extending into the connection chamber, is pneumatically seated on top of the fan and serves as the an intake duct for the fan.

The fan draws air from the filter chamber creating a vacuum therein which causes air to be drawn from the outside through any attached vacuum accessories and through the intake hose. The incoming air stream passes through the fluid within the fluid basin causing turbulence of the fluid. The turbulent fluid scrubs debris from the incoming air stream. The air stream ascends through the filter chamber, through the connection chamber, into the fan intake, out of the fan discharge ports, into an exhaust passage, and into the atmosphere through an opening.

By utilizing a turbulent fluid as a filter, the device provides for intense scrubbing of debris from the incoming air stream. As ascending air passes from the smaller lower air section to the larger upper air section, the air losses some energy and thus its ability to carry moisture up through the filter chamber. The filter removes any remaining moisture and debris. If any moisture collects within the connection chamber, the air duct prohibits moisture entry into the motor chamber.

The device provides a high degree of air filtration while preventing moisture from reaching the motor or the outside atmosphere. The device is of simple design and construction. Utilization and maintenance of the device is straightforward.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
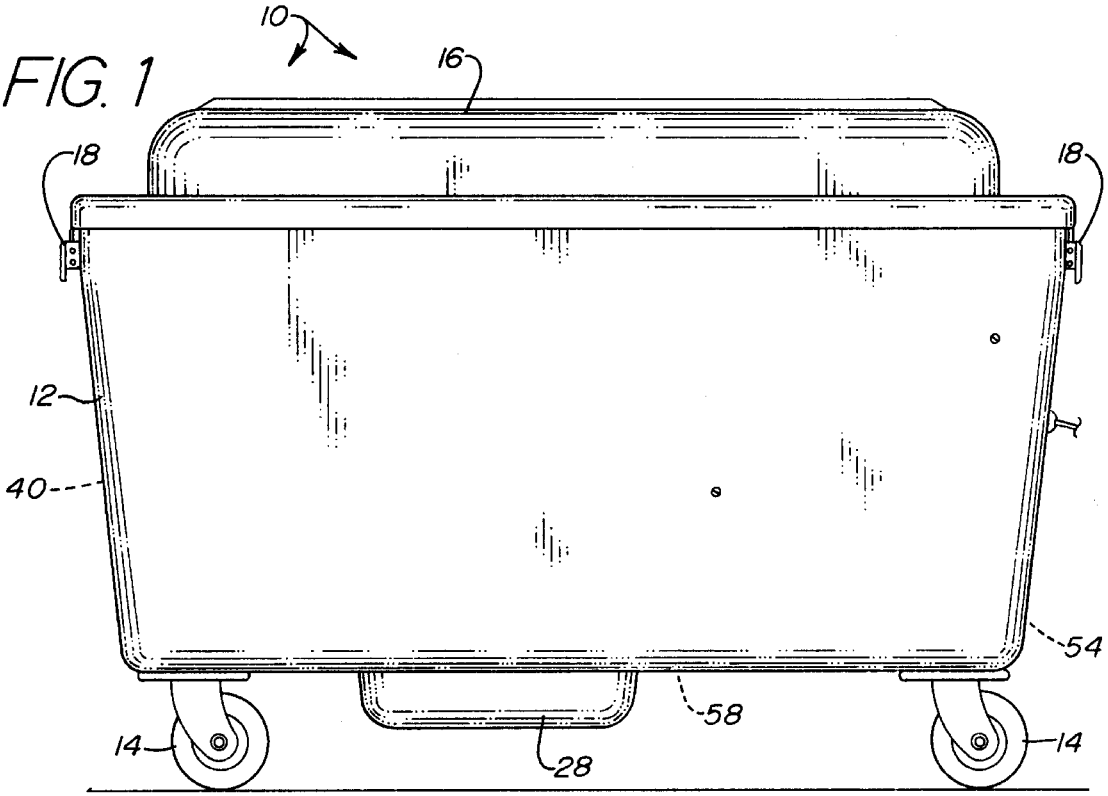
FIG. 1 is a a side elevation view of the vacuum cleaner of the present invention.
Figure 2:
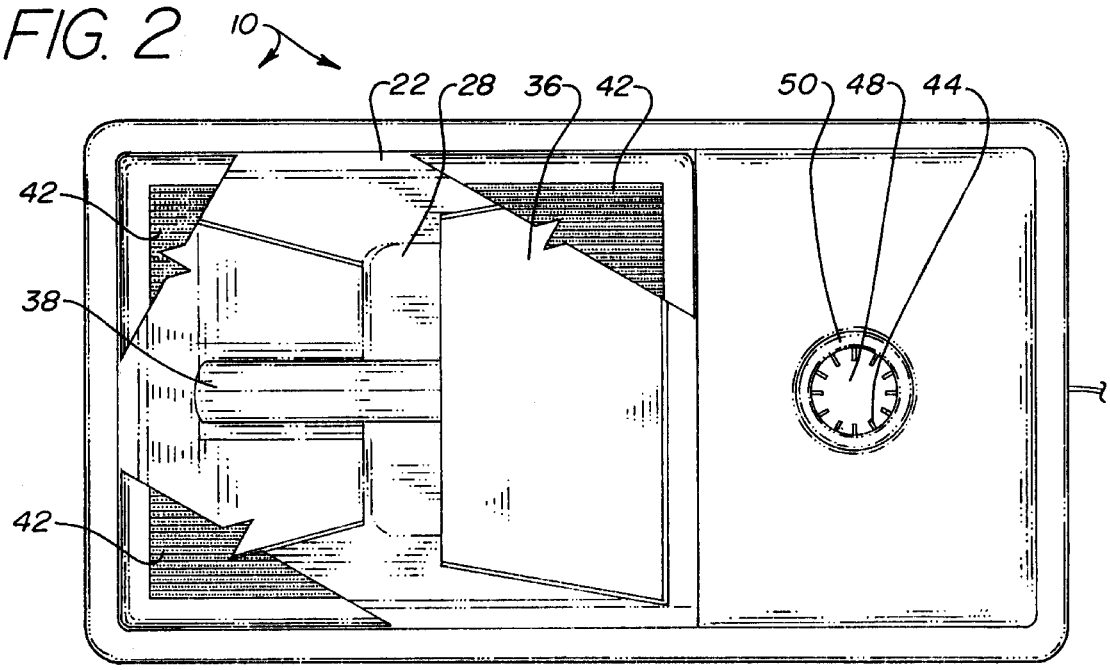
FIG. 2 is a top plan view of the vacuum cleaner with the lid removed.

Referring now to the drawings, it is seen that the vacuum cleaner of the present invention, generally denoted by reference numeral 10, is comprised of a housing 12, sitting on casters 14 and having a lid 16, either hingedly or removably secured thereto by latches 18 of any appropriate design. A gasket 20 secured to the lid 16 provides for a pneumatic seal of the housing 12. The housing 12 is separated into a filter chamber 22 and a motor chamber 24 fluid flow connected by a connection chamber 26. The filter chamber 22 is removably disposed within the housing 12.

Figure 3:
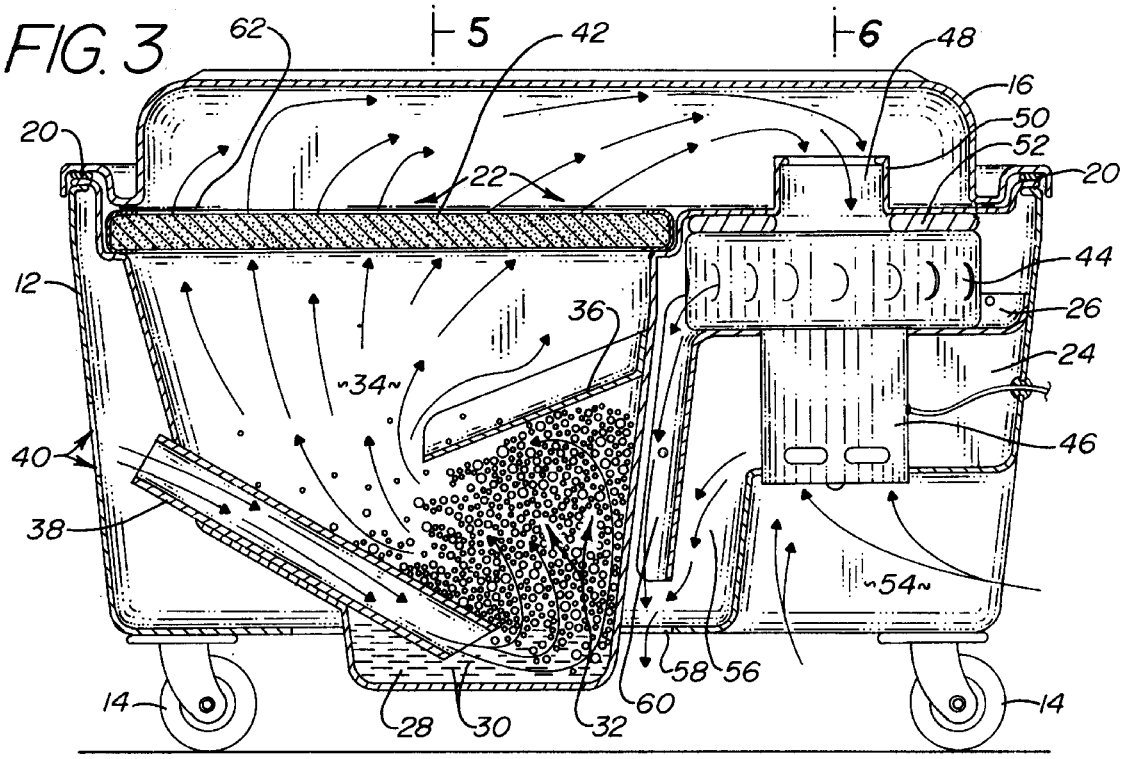
FIG. 3 is a cutaway view of FIG. 1.
Figure 4:
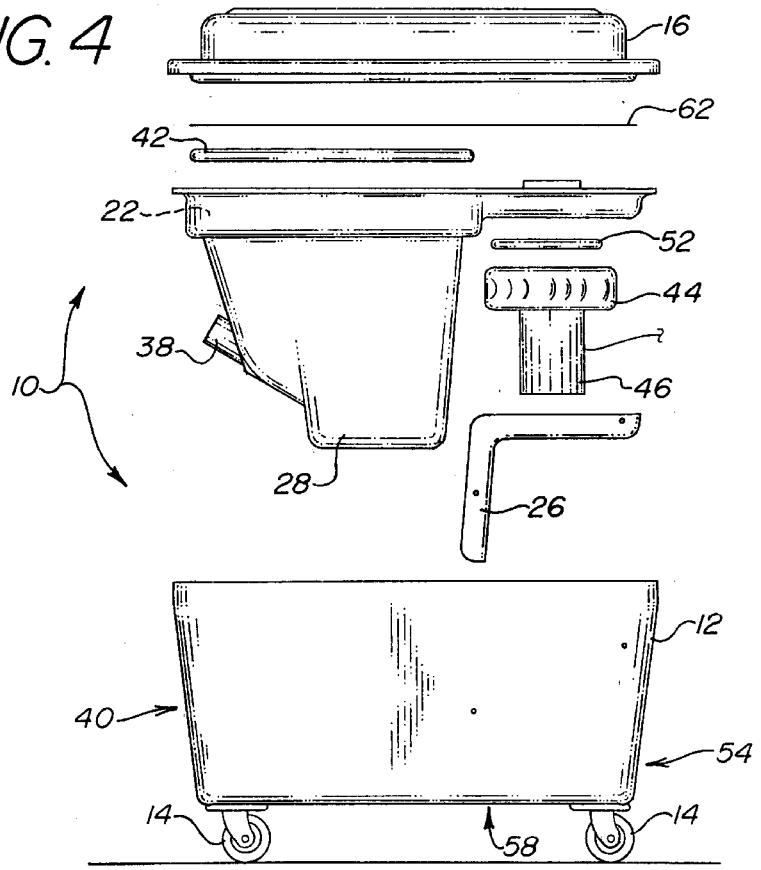
FIG. 4 is a partially exploded view of FIG. 1.
Figure 5:
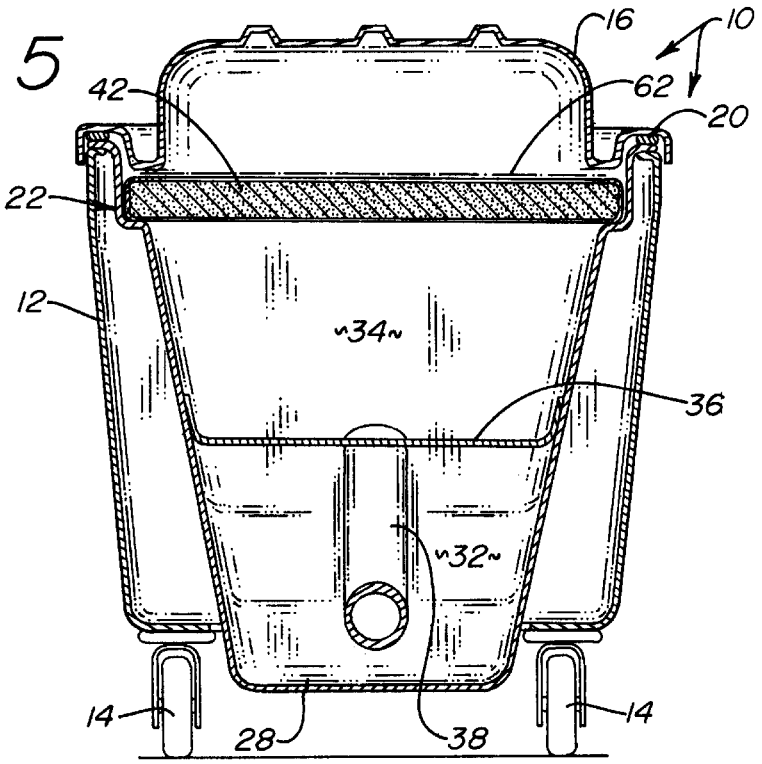
FIG. 5 is a sectioned view of FIG. 7.

As seen in FIG. 3, the filter chamber 22 has a fluid basin 28 holding a fluid 30, such as water, therein. Located above the fluid basin 28 is a lower air section 32 separated from an upper air section 34 by a diagonally disposed separator 36. The upper air section 34 is volumetrically larger than the lower air section 32. An air intake hose 38 extends from within the fluid 30 contained within the fluid basin 28 and terminates prior to the housing 12. The end of the air intake hose 38 faces an opening 40 located on the housing 12. A filter 42 having high fluid absorption capabilities, such as foam, fiber, or fabric, extends across the top of the filter chamber 22.

A fan 44 powered by a bypass motor 46 is located within the motor chamber 24 and has a fan intake 48. An air duct 50, that is integrally attached to the filter chamber 22 and having an opening, extends atop the motor chamber 24 and is seated on a gasket 52 located on the top of the fan 44 in order to provide a seal between the connection chamber 26 and the motor chamber 24. The fan intake 48 is registerable with the air duct 50 and proves the only fluid flow path between the connection chamber 26 and the motor chamber 24.

Figure 6:
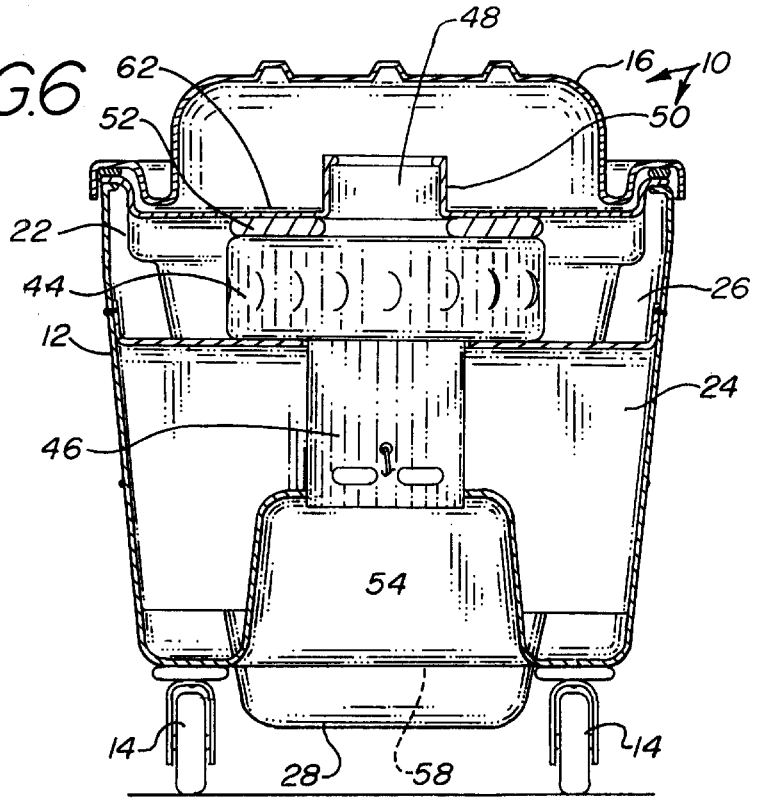
FIG. 6 is a sectioned view of FIG. 8.
Figure 7:
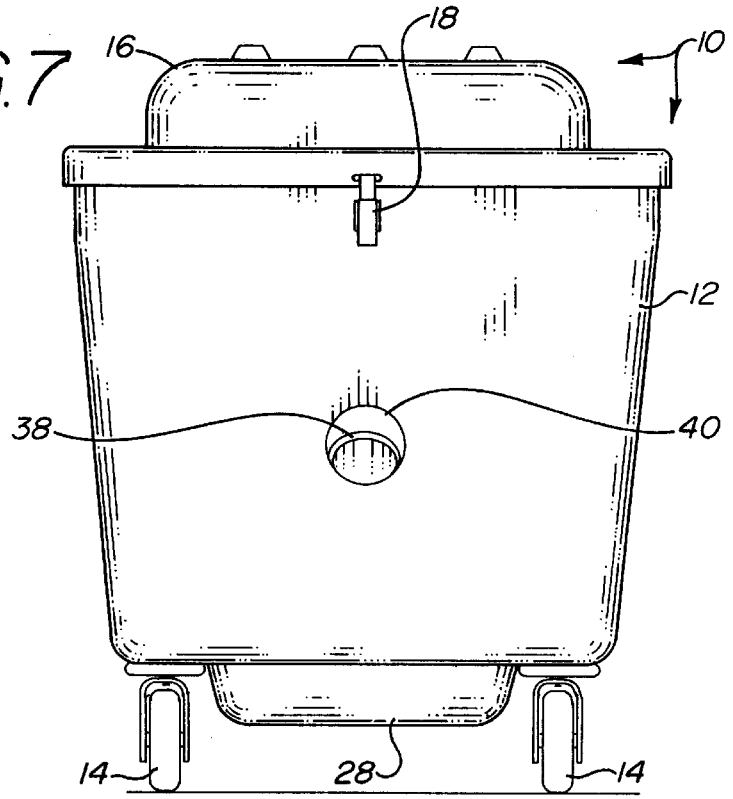
FIG. 7 is a front elevation view of the vacuum cleaner.
Figure 8:
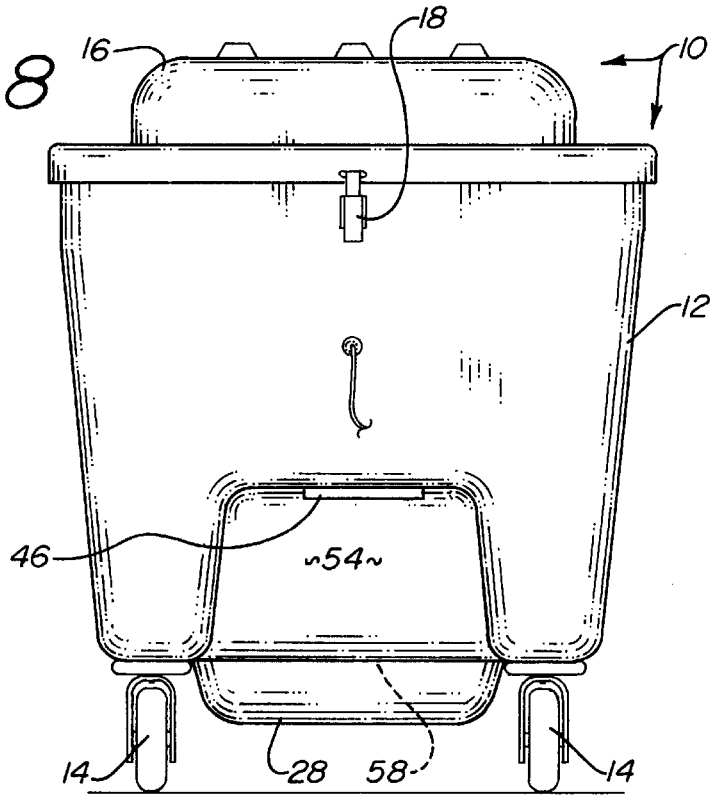
FIG. 8 is a rear elevation view of the vacuum cleaner.

As seen in FIG. 6, the housing 12, below the motor 46, is in a U-shaped straddle configuration in order to form an atmospheric air reservoir 54 to provide cooling air for the motor 46. An air duct 56 that extends to the outside atmosphere via opening 58 provides an exhaust channel for the working air of the fan 44 that is drawn up by the fan 44 from the air reservoir 54.

An air exhaust passage 60 extends from the fan 44 and terminates in the outside atmosphere through opening 58. Air that is drawn by the fan 44 through the fan intake 48 is discharged via the air exhaust passage 60.

In order to use the vacuum cleaner 10 of the present invention, a vacuum accessory, such as a vacuum hose (not illustrated) is connected to the end of the air intake hose 38. Fluid 30 is placed into the fluid basin 28. A filter 42 is pneumatically positioned on the top of the filter chamber 22. If necessary, a mesh 62, such as fiberglass mesh attachable to the lid 16, is positioned over the filter 42 in order to retain the filter 42 in place during device operation. The lid 16 is placed onto the housing 12 and is latched in place. Power is provided to the motor 46 in order to activate the fan. Upon fan 44 activation, the fan 44 draws air from the filter chamber 22 through the connection chamber 26 and discharges this air to the atmosphere through the air exhaust passage 60. As a result, a vacuum is created within the filter chamber 22 which causes air from the atmosphere to be pulled into the filter chamber 22 through the air intake hose 38 via any attached vacuum accessories. The incoming air passes through the air intake hose 38 and is discharged within the fluid 30 held within the fluid basin 28 causing intense turbulence within the fluid 30. The fluid turbulence scrubs the dirt and debris contained within the incoming air and holds the dirt within the fluid 30. The incoming air, having dirt and debris removed, exits the fluid 30 and passes up through the filter chamber 22, through the filter 42, into the connection chamber 26, enters the fan 44 through the fan intake 48, and is discharged into atmosphere through the air exhaust passage 60 completing the vacuum cycle.

The air exiting the fluid 30 will carry some moisture with it. Most of the moisture will drop back into the fluid basin 28 as the air passes from the smaller lower air section 32 to the larger upper air section 34 and slows down. The slower air has less energy and thus less ability to lift moisture. The remaining moisture will be absorbed by the filter 42. The filter 42 will also remove any remaining dirt and debris.

In order to replace the filter 42 or the fluid 30, the lid 16 is unlatched and removed from the top of the housing 12. The filter chamber 22 is removed and the filter 42 cleaned or replaced as necessary. The fluid 30 is dumped out and fresh fluid is introduced.

While the invention has been particularly shown and described with reference to an embodiment thereof, it will be appreciated by those skilled in the art that various changes in form and detail may be made without departing from the spirit and scope of the invention.

I claim:

1. A vacuum cleaner comprising:

a housing having a motor chamber, a first opening, and a lid removably attachable to the top of the housing;

a filter chamber having a fluid basin and an open top in fluid communication with the motor chamber, disposed within the housing;

an air intake hose having one end terminating within the fluid basin and the opposing end terminating proximate the first opening;

a filter removably disposed across the open top;

a fan, having a fan intake in fluid communication with the open top and at least one discharge port, disposed within the motor chamber;

an air duct integrally attached to the filter chamber over the fan intake and facing upwardly; and a motor for powering the fan.

2. The device as in claim 1 wherein the filter chamber is divided into an upper air section and a lower air section by a separator.

3. The device as in claim 1 wherein the filter chamber is removably disposed within the housing.

4. The device as in claim 1 further comprising a plurality of casters attached to the bottom of the housing.

5. The device as in claim 1 further comprising a mesh attached to the lid and positionable atop the filter for securing the filter across the open top.

6. The device as in claim 1 further comprising a gasket secured between the top of the fan and the bottom of the air duct.

7. The device as in claim 1 wherein the housing has a generally U-shaped straddle beneath the motor.

8. The device as in claim 1 wherein the motor is a bypass motor.

9. The device as in claim 1 wherein the lid is hingedly attached to the housing.

10. The device as in claim 1 further comprising one or more latches for securing the lid to the housing.

11. A vacuum cleaner comprising:

a housing having a motor chamber, a first opening, and a lid removably attachable to the top of the housing;

a filter chamber having a fluid basin and an open top in fluid communication with the motor chamber, removably disposed within the housing;

an air intake hose having one end terminating within the fluid basin and the opposing end terminating proximate the first opening;

a filter removably disposed across the open top;

a fan, having a fan intake in fluid communication with the open top and at least one discharge port, disposed within the motor chamber; and a motor for powering the fan.

12. The device as in claim 11 wherein the filter chamber is divided into an upper air section and a lower air section by a separator.

13. The device as in claim 11 further comprising an air duct securely positioned over the fan intake and facing upwardly.

14. The device as in claim 13 wherein the air duct is integrally attached to the filter chamber.

15. The device as in claim 13 further comprising a gasket secured between the top of the fan and the bottom of the air duct.

16. The device as in claim 11 further comprising a plurality of casters attached to the bottom of the housing.

17. The device as in claim 11 further comprising a mesh attached to the lid and positionable atop the filter for securing the filter across the open top.

18. The device as in claim 11 wherein the housing has a generally U-shaped straddle beneath the motor.

19. The device as in claim 11 wherein the motor is a bypass motor.

20. The device as in claim 11 wherein the lid is hingedly attached to the housing.

21. The device as in claim 11 further comprising one or more latches for securing the lid to the housing.

22. A vacuum cleaner comprising:

a housing having a motor chamber, a first opening, and a lid removably attachable to the top of the housing;

a filter chamber having a fluid basin and an open top in fluid communication with the motor chamber, disposed within the housing;

a mesh attached to the lid and positionable atop the filter for securing the filter across the open top;

an air intake hose having one end terminating within the fluid basin and the opposing end terminating proximate the first opening;

a filter removably disposed across the open top;

a fan, having a fan intake in fluid communication with the open top and at least one discharge port, disposed within the motor chamber; and a motor for powering the fan.

23. The device as in claim 22 wherein the filter chamber is divided into an upper air section and a lower air section by a separator.

24. The device as in claim 22 further comprising an air duct securely positioned over the fan intake and facing upwardly.

25. The device as in claim 24 wherein the air duct is integrally attached to the filter chamber.

26. The device as in claim 24 further comprising a gasket secured between the top of the fan and the bottom of the air duct.

27. The device as in claim 11 wherein the filter chamber is removably disposed within the housing.

28. The device as in claim 22 further comprising a plurality of casters attached to the bottom of the housing.

29. The device as in claim 22 wherein the housing has a generally U-shaped straddle beneath the motor.

30. The device as in claim 22 wherein the motor is a bypass motor.

31. The device as in claim 22 wherein the lid is hingedly attached to the housing.

32. The device as in claim 22 further comprising one or more latches for securing the lid to the housing.

33. A vacuum cleaner comprising:

a housing having a motor chamber, a first opening, a U-shaped straddle, and a lid removably attachable to the top of the housing;

a filter chamber having a fluid basin and an open top in fluid communication with the motor chamber, disposed within the housing;

an air intake hose having one end terminating within the fluid basin and the opposing end terminating proximate the first opening;

a filter removably disposed across the open top;

a fan, having a fan intake in fluid communication with the open top and at least one discharge port, disposed within the motor chamber; and a motor, positioned above the U-shaped straddle, for powering the fan.

34. The device as in claim 33 wherein the filter chamber is divided into an upper air section and a lower air section by a separator.

35. The device as in claim 33 further comprising an air duct securely positioned over the fan intake and facing upwardly.

36. The device as in claim 35 wherein the air duct is integrally attached to the filter chamber.

37. The device as in claim 35 further comprising a gasket secured between the top of the fan and the bottom of the air duct.

38. The device as in claim 33 wherein the filter chamber is removably disposed within the housing.

39. The device as in claim 33 further comprising a plurality of casters attached to the bottom of the housing.

40. The device as in claim 33 further comprising a mesh attached to the lid and positionable atop the filter for securing the filter across the open top.

41. The device as in claim 33 wherein the motor is a bypass motor.

42. The device as in claim 33 wherein the lid is hingedly attached to the housing.

43. The device as in claim 33 further comprising one or more latches for securing the lid to the housing.

* * * * *